US011937684B1

(12) United States Patent
Proctor

(10) Patent No.: US 11,937,684 B1
(45) Date of Patent: Mar. 26, 2024

(54) BEAUTY APPLICATOR SYSTEMS AND RELATED METHODS

(71) Applicant: Summer Proctor, Glendale, AZ (US)

(72) Inventor: Summer Proctor, Glendale, AZ (US)

( * ) Notice: Subject to any disclaimer, the term of this patent is extended or adjusted under 35 U.S.C. 154(b) by 0 days.

(21) Appl. No.: 18/180,049

(22) Filed: Mar. 7, 2023

Related U.S. Application Data

(62) Division of application No. 16/443,496, filed on Jun. 17, 2019, now abandoned.

(60) Provisional application No. 62/687,036, filed on Jun. 19, 2018.

(51) Int. Cl.
*A45D 44/00* (2006.01)
*A45D 40/26* (2006.01)

(52) U.S. Cl.
CPC ..... *A45D 44/002* (2013.01); *A45D 40/26* (2013.01); *A45D 2200/1009* (2013.01)

(58) Field of Classification Search
CPC ..... A45D 44/002; A45D 40/26; A45D 2200/1009; A45D 34/04; A45D 2200/00; A45D 2200/10; A45D 2200/1018; A45D 2200/1036
USPC ..... 132/319; 401/6
See application file for complete search history.

(56) References Cited

U.S. PATENT DOCUMENTS

| | | | |
|---|---|---|---|
| 5,078,160 | A | 1/1992 | Carbonnier |
| 5,919,476 | A | 7/1999 | Fischer et al. |
| 5,957,142 | A | 8/1999 | Karafilis |
| 6,528,154 | B1 | 3/2003 | Yamato |
| 6,537,308 | B2 | 3/2003 | Burkhart |
| 9,113,692 | B2 | 8/2015 | Khan et al. |
| 9,161,606 | B1 | 10/2015 | Wong |
| 9,498,409 | B2 | 11/2016 | Phukan et al. |
| 9,867,449 | B2 | 1/2018 | LaHood, Sr. et al. |
| 10,842,242 | B2 | 11/2020 | Alary et al. |
| 2004/0109720 | A1 | 6/2004 | Gruenbacher et al. |
| 2008/0053476 | A1 | 3/2008 | LaHood et al. |
| 2012/0192884 | A1 | 8/2012 | Nasu et al. |
| 2014/0023689 | A1 | 1/2014 | Kim et al. |
| 2015/0173487 | A1 | 6/2015 | Wardaszka |
| 2016/0022014 | A1 | 1/2016 | Ajiki et al. |

(Continued)

FOREIGN PATENT DOCUMENTS

| | | | |
|---|---|---|---|
| CN | 106283392 | A | 1/2017 |
| DE | 10327707 | A1 | 4/2004 |

(Continued)

OTHER PUBLICATIONS

Themakeupchair, Press on Makeup Face Mask—Does it Work?, Retrieved from the Internet: https://www.youtube.com/watch?v=v84yTH3u-6s, Downloaded on May 17, 2018, 3 pages.

(Continued)

*Primary Examiner* — David J Walczak
(74) *Attorney, Agent, or Firm* — IPTechLaw

(57) ABSTRACT

Implementations of beauty applicators may include: a mask having a first side and a second side. The mask may have the shape of a human face. The first side of the mask may be configured to couple with a surface of a user's face. The beauty applicator may include one or more sponges coupled to the first side of the mask. Each of the sponges may be coupled to the mask in a predetermined location. Each of the one or more sponges may be configured to be impregnated with a liquid make-up solution.

13 Claims, 4 Drawing Sheets

(56) References Cited

U.S. PATENT DOCUMENTS

| | | | | |
|---|---|---|---|---|
| 2017/0027305 | A1 | 2/2017 | Yost | |
| 2018/0015028 | A1 | 1/2018 | Howard et al. | |
| 2018/0206616 | A1* | 7/2018 | Alary | A61Q 19/00 |

FOREIGN PATENT DOCUMENTS

| | | | |
|---|---|---|---|
| EP | 2460435 | A1 | 6/2012 |
| KR | 100871282 | B1 | 11/2008 |
| KR | 20150019056 | A | 2/2015 |

OTHER PUBLICATIONS

Lee. Press on Eyeshadow Does it work ?! Youtube. Aug. 28, 2016 (Aug. 28, 2016) [Retrieved on .,,. Aug. 7, 2019]. Retrieved from internet: <URL https://www.youtube.com/watch? v=c_SRvBEYIsc> entire video, 3 pages.

International Search Report, PCT Patent Application No. PCT/US2019/037535, dated Sep. 5, 2019, 2 pages.

* cited by examiner

BEAUTY APPLICATOR SYSTEMS AND RELATED METHODS

CROSS REFERENCE TO RELATED APPLICATIONS

This document claims the benefit of the filing date of U.S. Provisional Patent Application 62/687,036, entitled "Beauty Applicator Systems and Related Methods" to Summer Proctor which was filed on Jun. 19, 2018, the disclosure of which is hereby incorporated entirely herein by reference.

This application is also a divisional application of the earlier U.S. Utility Patent Application to Summer Proctor entitled "Beauty Applicator Systems and Related Methods," application Ser. No. 16/443,496, filed Jun. 17, 2019, now pending, the disclosure of which is hereby incorporated entirely herein by reference.

BACKGROUND

1. Technical Field

Aspects of this document relate generally to beauty applicator systems, such as masks for applying specific make-up configurations. More specific implementations involve an apparatus for applying cosmetics having a contour pallet.

2. Background

Conventionally, cosmetics, including make-up, have been applied by brushes, sponges, and fingertips in individual zones. Foundation may be applied to the forehead, chin, cheeks, nose, and jawline one area at a time. Additional make-up such as blush or rouge, eye shadow, lipstick, and other highlighting components are applied to the cheeks, eyelids, and lips, respectively, and layered over the foundation.

SUMMARY

Implementations of beauty applicators may include: a mask having a first side and a second side. The mask may have the shape of a human face. The first side of the mask may be configured to couple with a surface of a user's face. The beauty applicator may include one or more sponges coupled to the first side of the mask. Each of the sponges may be coupled to the mask in a predetermined location. Each of the one or more sponges may be configured to be impregnated with a liquid make-up solution.

Implementations of beauty applicators may include one, all, or any of the following:

The mask may be formed of silicone, plastic, plaster thermoplastics, or any combination thereof.

The one or more sponges may be coupled to the first side of the mask through an adhesive.

The sponges may be configured to correspond with at least a forehead of the user, one or more eyebrows of the user, a nose of the user, one or more cheekbones of the user, or a chin of the user.

The sponges may be configured to be washable and reusable with the mask.

The one or more sponges may include a different shade of the liquid make-up solution depending on the predetermined location of the sponge.

Implementations of beauty applicators may include: a mask having a first side and a second side. The mask may include a shape of a human face. The first side of the mask may be configured to couple with a surface of a user's face. The system may also include one or more sponges coupled to the first side of the mask. The system may also include a tray corresponding with the shape of the mask. The tray may include one or more cavities corresponding with a position of each of the one or more sponges. The one or more cavities may provide a seal substantially around the one or more sponges.

Implementations of beauty applicators may include one, all, or any of the following:

The mask may be formed of silicone, plastic, plaster, thermoplastics, or any combination thereof.

The one or more sponges may be coupled to the first side of the mask through an adhesive.

The sponges may be configured to correspond with at least a forehead of the user, one or more eyebrows of the user, a nose of the user, one or more cheekbones of the user, or a chin of the user.

The beauty applicator tray may also include tabs on one or more edges of the tray. The tabs may be configured to couple with the mask.

Make up may be applied to a face of a user using implementations of a beauty applicator, the method may include: providing a mask. The mask may include a first side and a second side. The mask may have a shape of a human face. The first side of the mask may be configured to couple with a surface of a user's face. One or more sponges may be coupled to the first side of the mask in one or more predetermined locations. The method also includes applying a liquid make-up solution to the one or more sponges and coupling the mask to the surface of the user's face. The method also includes transferring the liquid make-up solution to the surface of the user's face by applying pressure to the second side of the mask.

Implementations of beauty applicators may include one, all, or any of the following:

The method may also include blending the liquid make-up solution on the user's face through one of stippling, rubbing, blending, or any combination thereof.

Blending of the liquid make-up solution may be performed with brushes or one or more blending sponges.

The mask may be formed of silicone, plastic, plaster, thermoplastics, or any combination thereof.

The one or more sponges may be coupled to the first side of the mask through an adhesive.

The sponges may be configured to correspond with at least a forehead of the user, one or more eyebrows of the user, a nose of the user, one or more cheekbones of the user, or a chin of the user.

The sponges may be configured to be washable and reusable with the mask.

The one or more sponges may include a different shade of the liquid make-up solution depending on the predetermined location of the sponge.

The liquid make-up may be one of foundation make-up, blush, bronzer, highlighter, eye shadow, or any combination thereof.

Implementations of a beauty applicator may be setting up using a method for setting up a beauty applicator system, the method may include: providing a mask. The mask may include a first side and a second side. The mask may be in a shape of a human face. The first side of the mask may be configured to couple with a surface of a user's face. The method may include coupling one or more sponges to the first side of the mask in one or more predetermined locations. The method may include applying a liquid make-up solution to the one or more sponges.

Implementations of beauty applicators may include one, all, or any of the following:

Coupling one or more sponges to the first side of the mask may include using an adhesive.

The method may also include coupling the mask to a tray. The tray may correspond with the shape of the mask. The tray may include one or more cavities corresponding with a position of each of the one or more sponges. The one or more sponges are encapsulated in the one or more cavities.

The make-up solution may be one of foundation make-up, blush, bronzer, highlighter, eye shadow, or any combination thereof.

The one or more sponges may include a different shade of the liquid make-up solution depending on the predetermined location of the sponge.

The predetermined location of the one or more sponges may be configured to correspond with at least a forehead of the user, one or more eyebrows of the user, a nose of the user, one or more cheekbones of the user, or a chin of the user.

The mask may be formed of silicone, plastic, plaster, thermoplastics, or any combination thereof.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended beauty applicator will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such beauty applicator, and implementing components and methods, consistent with the intended operation and methods.

Figure 1:
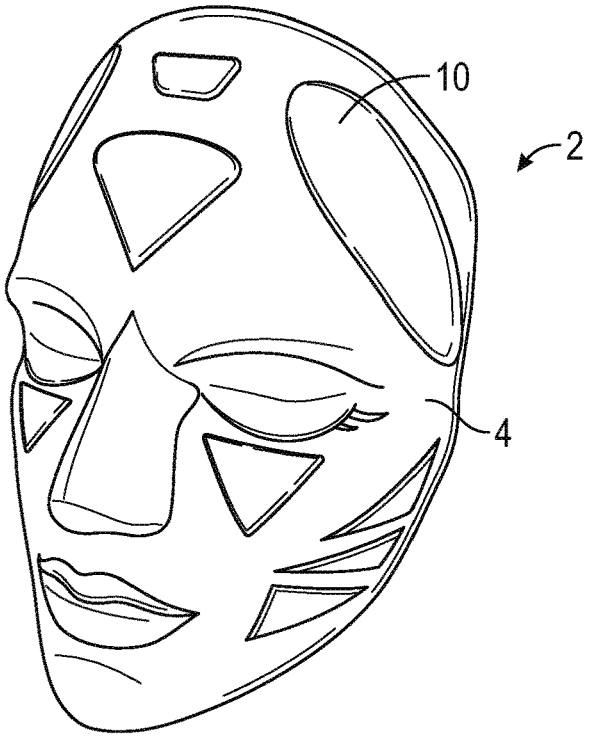
FIG. 1 is a perspective view of an implementation of a beauty applicator mask.

Referring to FIG. 1, an implementation of a beauty applicator mask 2 is illustrated. The beauty applicator mask 2 is part of a beauty applicator system. The beauty applicator mask has the shape of a human face. In various implementations, the beauty applicator mask may be custom made for an individual. By non-limiting example, a user may input a picture of his/her face into a computing program and a beauty application mask may be generated to conform with the inputted shape to the face of the user. In various implementations, a computing program will analyze, by non-limiting example, light levels, shadowing, proportions, and other observed and/or raw data in the picture and develop a 3D map of the user's face. In various implementations, the beauty applicator mask may be generated by a 3D printer. In some implementations, a mold may be created to the shape of a user's face so multiple beauty applicator masks may be created for the same user. In such implementations, the mold may be formed by applying molding material to the user's face, or having the user place his or her face into the molding material. The resulting impression may then be used to develop a subsequent mold for use in producing the beauty application mask.

Figure 2:
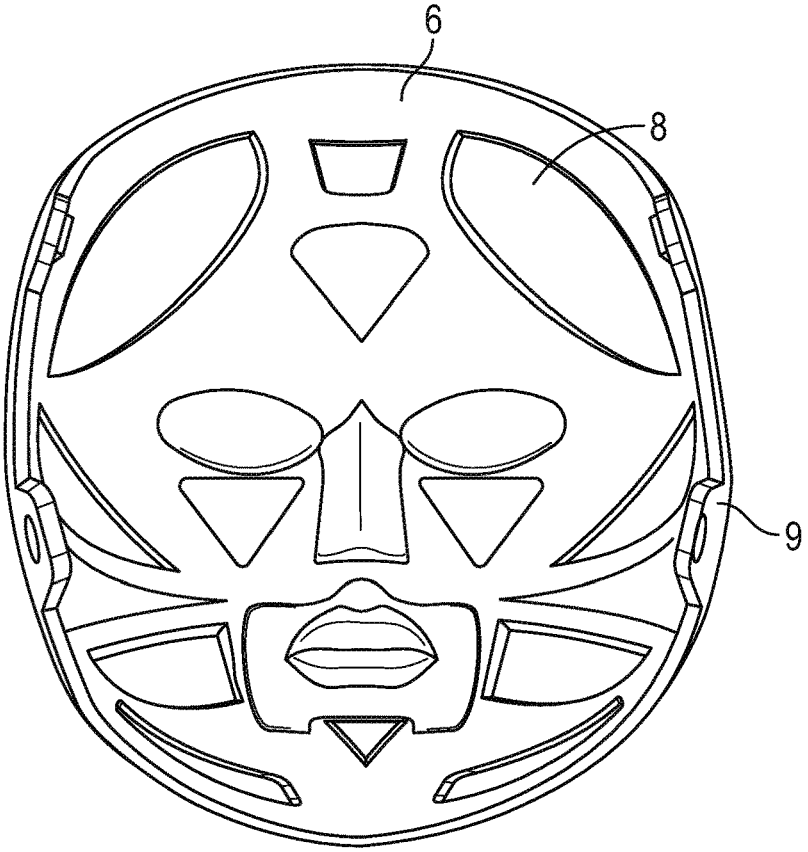
FIG. 2 is a front view of a first side of the mask.

In other implementations, the beauty applicator masks may be formed with a more generalized shape for use with a variety of users without corresponding exactly with a particular user's facial features. By non-limiting example, the general shapes of various implementations of beauty applicator masks may be oval, triangle, diamond, rectangle, square, round, heart-shaped, oblong, or other closed shapes that can correspond with facial proportions. The beauty applicator mask maybe formed of silicone, plastic, plaster, thermoplastics, any combination thereof, or any material that holds a shape and is also flexible to be formed to the face of a user. The mask 2 has a first side and a second side 4. Referring to FIG. 2, the first side 6 of the mask is illustrated. The first side of the mask is configured to couple with a surface of a user's face. The first side of the mask includes recesses or clips 9 that may be used to couple the mask with implementations of a beauty applicator tray 20 as will be explained in more detail with FIGS. 5-7. The mask 2 may be removably coupled with the tray 20 for storage and packaging for shipping or retail sales. In various implementations, the mask coupled with the tray may be stored without sponges. In some implementations, the mask coupled with the tray may be stored with sponges coupled with the mask. In implementations with the sponges coupled with the mask, the sponges may include liquid makeup solution thereon.

The beauty applicator system may also include one or more sponges. The one or more sponges may be coupled to the first side of the mask in predetermined locations. As illustrated in FIG. 2, the predetermined locations 8 are formed into the first side of the mask. In various implementations, the predetermined locations may be recesses in the mask. Referring to FIG. 1, the predetermined locations 10 are also visible from the second side 4 of the mask. The one or more sponges may be coupled to the first side of the mask through an adhesive. In various implementations, the one or more sponges may be preassembled to the mask. In other implementations, the one or more sponges may be equipped with an adhesive backing covered with a disposable paper. The disposable paper may be removed and applied to the mask in the predetermined locations. In various implementations, one or more sponges may also be coupled to the beauty applicator tray in other positions not illustrated in the figures such as the eyebrows, mustache area, and other positions on the face where a user may intend to apply makeup. In some implementation, the sponges may be in shapes other than those illustrated in the figures such as by non-limiting example, circles, squares, trapezoids, and any other closed shapes useful to applying makeup in particular configurations.

Implementations of a beauty applicator system may be prepared using a method of preparing the beauty applicator system. The method may include providing a mask as illustrated in FIG. 1. As previously explained, the mask may include a first side and a second side and the first side may be configured to couple with a surface of a user's face. The method may also include coupling one or more sponges to the first side of the mask in one or more predetermined locations. In various implementations, the sponges may include a first surface and a second surface. The first surface of the sponge may include an adhesive material covered with a removable film. In some implementations, the removable film may include a paper material. In other implementations, the removable film may include a plastic material. The method may include removing the removable film from the first side of the sponges and applying the sponges to the predetermined locations on the mask. In various implementations, the sponges described herein may be made of, by non-limiting example, low density Styrene Butadiene Rubber (SBR) latex-free foam, cellulose, cotton, hydrophilic latex-free polyurethane (PU) foam, latex-free PU ester foam, latex-free PU foam, neoprene, or other polymeric or compatible materials useful for applying make-up to a user's face. In other implementations, the sponges may be coupled to the mask by applying glue to the predetermined position on the mask and then coupling the sponge to the mask and the glue. In still other implementations, coupling the sponges to the mask may include applying glue to the first side of the sponge and then coupling the sponge with glue to the mask.

The method of preparing a beauty applicator system for use may include applying a liquid make-up solution to each of the sponges. In various implementations, a different shade of liquid make-up may be applied to each of the different sponges. The shade of liquid make-up may be determined by the location of the sponge on the mask that corresponds to a particular location on a user's face. For example, lighter colors may be used to contour the cheeks requiring a lighter liquid foundation shade on the sponges that correspond to the cheeks of a user. In other implementations, other types of liquid make-up may be used. By non-limiting example, the liquid make-up solutions may include foundation, concealer, blush, eye shadow, eye liner, lip stick and other make-up that may be made in a liquid form. After the beauty applicator mask and sponges have been prepared, the mask and sponges may be applied to the face of a user to apply make-up. In other implementations, the beauty applicator system, including the sponges coupled to the mask may be stored for usage at another time by coupling the mask to a beauty applicator tray as illustrated in FIG. 3.

Figure 3:
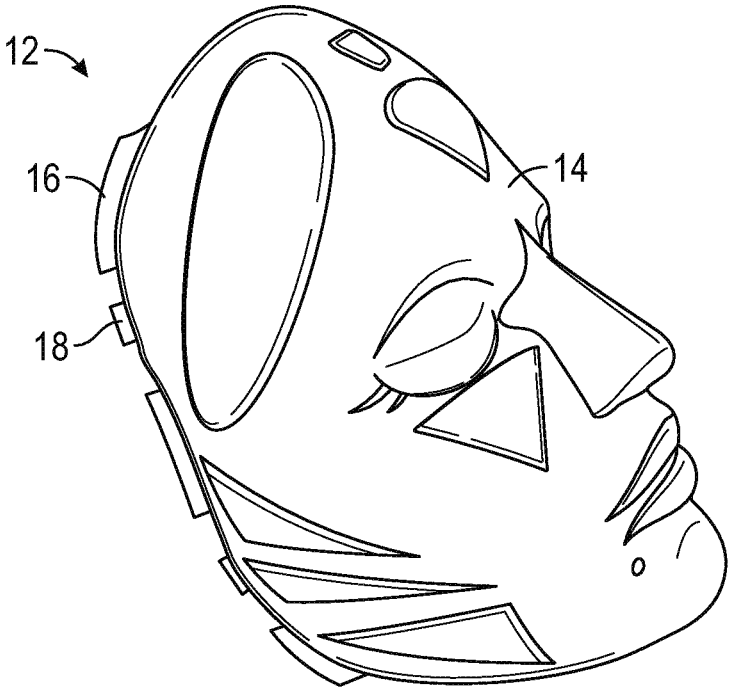
FIG. 3 is a left side view of an implementation of a beauty applicator mask coupled with an implementation of a make-up applicator tray.
Figure 4:
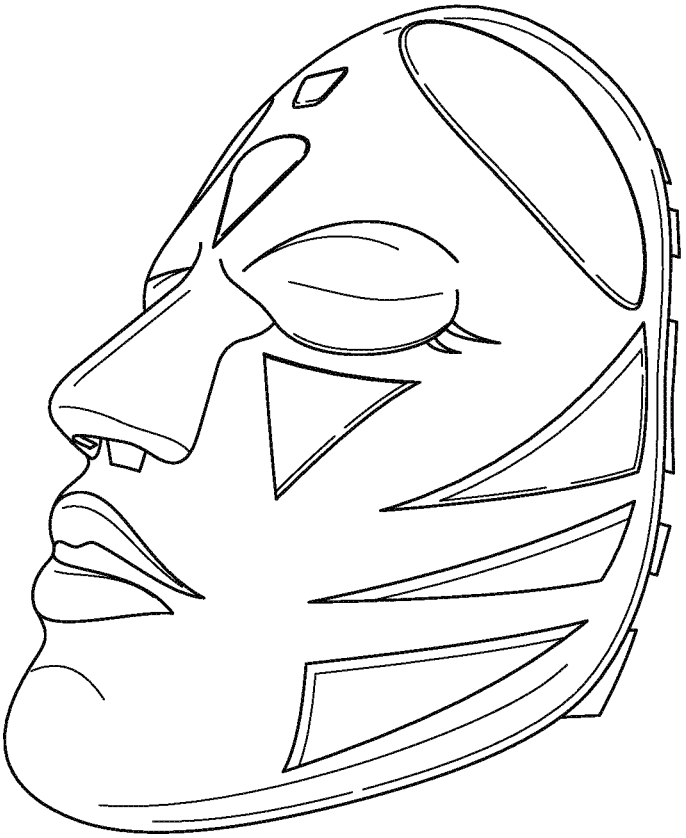
FIG. 4 is a right side view of an implementation of a beauty applicator mask coupled with an implementation of a make-up applicator tray.

Referring to FIG. 3, an implementation of a beauty applicator system 12 is illustrated. In FIG. 3, a left side view of an implementation of a beauty applicator system is illustrated. In FIG. 4, a right side view of an implementation of a beauty applicator system is illustrated. The beauty applicator system includes a mask 14. In various implementations, the mask may be made of silicone, plastic, plaster, thermoplastics, or any other material described herein. The mask is formed in the shape of a human face. In various implementations, the mask may be customized to the user. In various implementations, the beauty applicator mask may be generated by a three dimensional (3D) printer. As previously described, a user may input a picture of his/her face into a computing program and a beauty application mask may be generated to conform with the inputted shape to the face of the user. In various implementations, computing program will analyze, by non-limiting example, light levels, shadowing, proportions, and other observed and/or raw data in the picture and develop a 3D map of the user's face. In other implementations, a mold of a user's face may be formed by applying molding material to the user's face, or having the user place his or her face into the molding material. The resulting impression may then be used to develop a subsequent mold for use in producing the beauty application mask. The beauty applicator tray may also include one or more sponges coupled to the first mask as previously described. Though the first side of the mask is not visible in this view, the locations of the sponges are visible from the second side of the mask.

Still referring to FIG. 3, the beauty applicator system 12 also includes a tray 16 corresponding with the shape of the mask. The tray may include one or more cavities that correspond with a position of each of one or more sponges on the mask. In this view, tabs 18 on an edge of the tray 16 are visible under the mask 14. In various implementations, one or more tabs may be positioned on one or more edges of the tray. The tabs may allow an airtight seal to be formed when the mask is stretched across the tray. The airtight seal may be formed around each of the sponges that may be positioned in each of the corresponding cavities on the tray. The airtight seal may allow a user to apply more than one application of liquid make-up solution on each of the individual sponges and store for later use. The mask may have corresponding recesses 9 as illustrated in FIG. 2 that are configured to couple with the tabs on the tray in order to removably couple with the tray.

Figure 5:
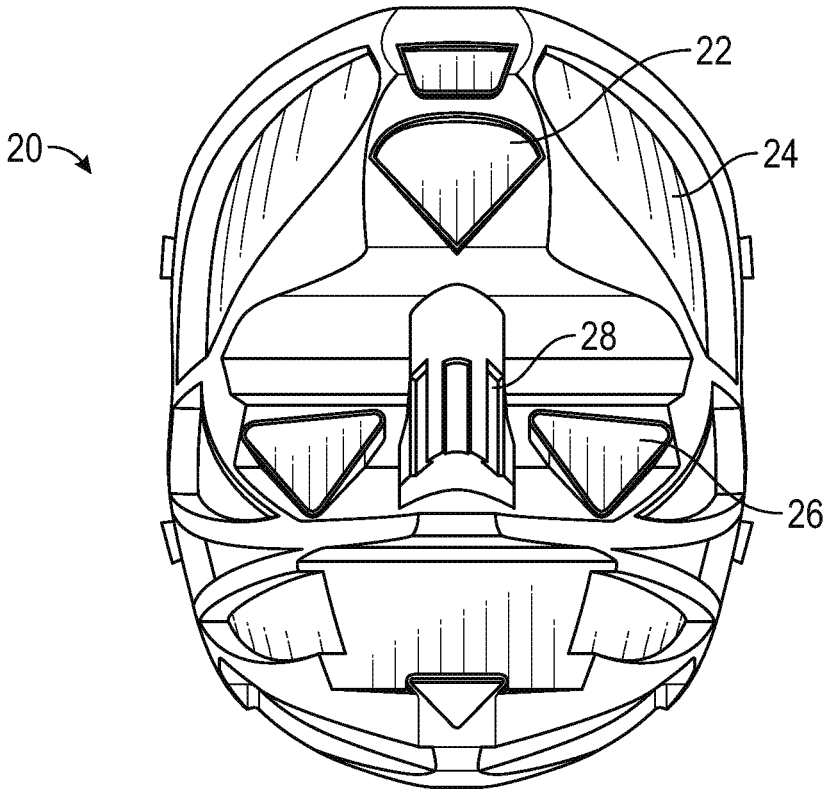
FIG. 5 is a front view of an implementation of a make-up applicator tray.

Referring to FIG. 5, a front view of an implementation of a beauty applicator tray 20 is illustrated. As illustrated, the tray corresponds with the shape of the mask. Though in various implementations of beauty applicator systems, the beauty application mask may be used without the beauty applicator tray. In various implementations, the tray may be formed, by non-limiting example, of closed-cell extruded polystyrene foam (XPS), plastic, or other polymeric or formable materials. In some implementations, the tray may be made using 3D printing technology and may be formed of any material used in 3D printing such as, by non-limiting example, resin, nylon, thermoplastic, or polycarbonates. The tray includes cavities 22 that correspond with the shape of the one or more sponges configured to be coupled with the beauty applicator mask. As illustrated, the one or more cavities on the tray may include irregular shapes as illustrated by 24. The one or more cavities may also include triangles 26 or rectangles 28. The cavities may aid in providing an airtight seal for sponges coupled with the mask. The cavities may provide an airtight seal for sponges whether or not the sponges are impregnated with a liquid make-up solution.

Figure 6:
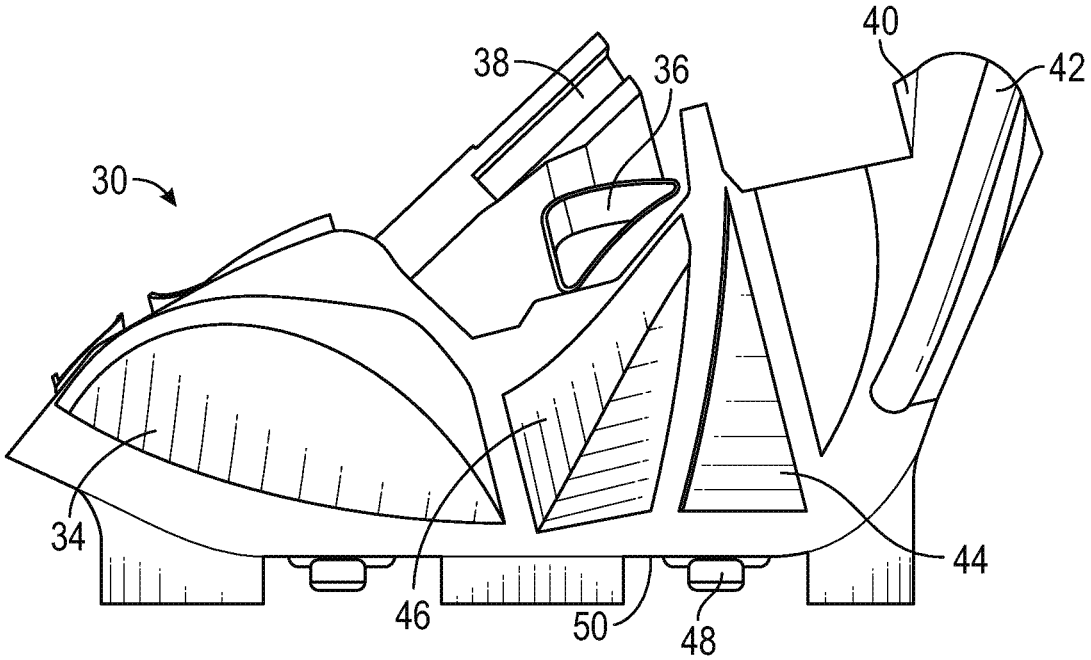
FIG. 6 is a side view of an implementation of a make-up applicator tray.

Referring to FIG. 6, a side view of an implementation of a tray 30 as described herein is illustrated. Various locations and shapes of the cavities are illustrated. The cavities may correspond with a variety of locations on the face of a human, such as by non-limiting example, the forehead 34, under the eyes 36, the top and side of the nose 38, under the lips 40, the chin 42, the jawline 44, the cheekbones 46, and other positions on the face. The one or more sponges coupled to the mask will also correspond with these various facial features of a user.

The tray also includes tabs 48 on the edges 50 of the tray 30. The tray may include one or more tabs on either side of the tray. The tabs are configured to couple with recesses in the mask. When the mask is coupled with the tray, an airtight seal may be formed around the sponges through the walls of the cavities. The airtight seal may allow for multiple uses of the sponges by a single user. In other implementations, the airtight seal may serve to keep unused sponges clean between uses of the mask.

Figure 7:
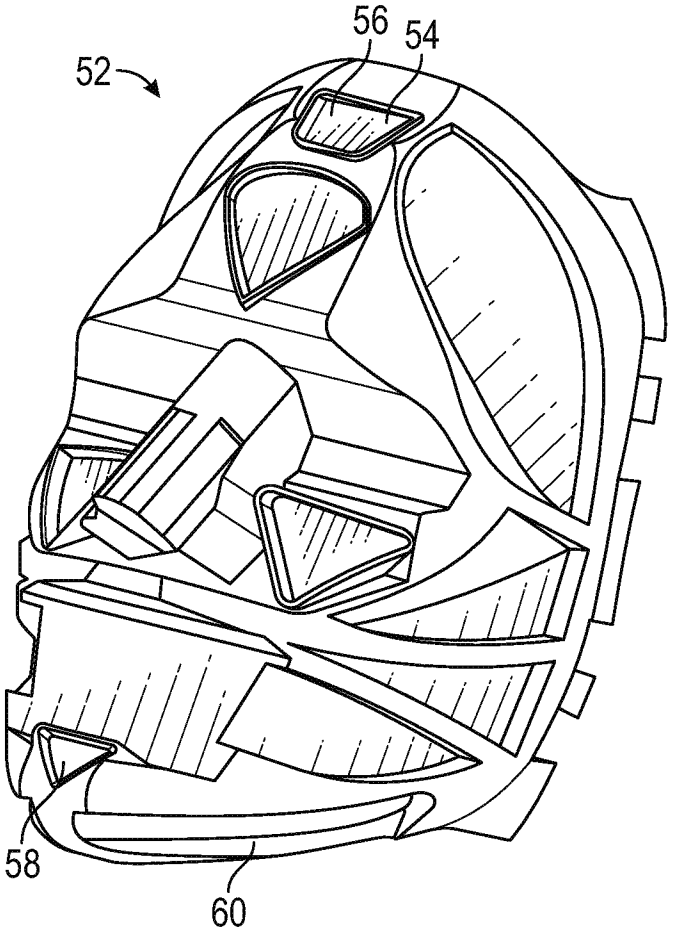
FIG. 7 is a perspective view of an implementation of a make-up applicator tray.

In FIG. 7, a perspective view of an implementation of the tray 52 is illustrated. In this perspective view, other implementations of cavities 54 are illustrated. For example, a cavity located in a position corresponding with the upper forehead 56 of the user is illustrated. A position 58 under the lips includes a cavity having a shape of a triangle is illustrated. A cavity having a shape of a rectangular strip is illustrated at a position corresponding with a jawline of a user. The one or more cavities on the tray correspond with the one or more predetermined locations of the one or more sponges coupled to the mask.

Figure 8:
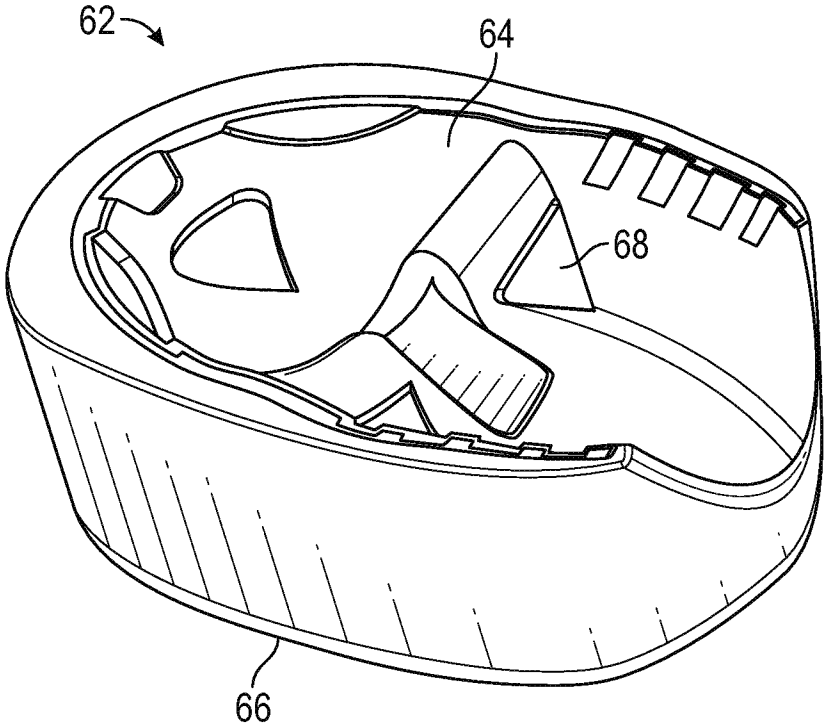
FIG. 8 is a perspective view of a back of an implementation of a make-up applicator tray mold.

Referring to FIG. 8, a mold 62 for forming an implementation of a mask is illustrated. The mold 62 has a first side 64 and a second side 66. The first side may be configured to receive material to be used in the formation of a beauty applicator mask as described herein. The first side 64 includes indentations 68 that correspond to the locations of the sponges configured to be coupled to the mask. The indentations also correspond to the locations of the cavities previously described on the tray. The mask may be formed through injection molding, transfer molding, compression molding, or other methods for forming silicone, rubber, or composite thermoplastic products on a physical mold or into a cavity. In various implementations, the mask may also be formed through 3D printing technology.

Various implementations, of the beauty applicator system as described herein may be used to provide a contouring look using liquid make-up. A method for applying make-up using a beauty applicator system may include providing a mask. The mask may be in the shape of a human face and may have a first side and a second side as previously described. The mask may be formed of silicone or other firm and pliable materials. One or more sponges may be removably coupled to a first side of the mask. The sponges may be coupled to the mask in positions corresponding to particular features of the human face where make-up is applied such as by non-limiting example, the forehead, chin, cheeks, nose, jawbones, and other facial features. The method may include applying a liquid make-up solution to each of the one or more sponges. The make-up may include liquid foundation in various implementations. In other implementations, the make-up solution may include blush, eye shadow, lipstick, or other make-ups that can be produced in liquid form. Different shades or colors of make-up may be applied to different sponges depending on the location of the sponge. The make-up solution may be applied by a pipet, by pouring, by use of a brush, or by other suitable method/system for transferring make-up, including applying liquid make-up to the surface of a sponge.

The method may include coupling the mask to a face of a user. The mask may be removably coupled to the user's face by holding the mask to the skin of the user's face and holding it in position. Transferring the make-up to the skin of the user may include applying pressure to the second side of the mask. Focused pressure may be applied in the areas of the mask where the sponges are coupled thereto. The method may include removing the mask from the face of the user after transferring the make-up. In various implementations, the sponges may be removed from the mask after application of the make-up to the user's face. In some implementations, additional make-up may remain on the sponges and may be used at a different time. If the user intends to reuse the sponges with addition make-up solution, the mask may be coupled with a tray as described herein. Recesses in the mask may be coupled with tabs on the end of the tray to provide a substantially airtight seal to each of the one or more sponges corresponding with one or more cavities on the tray. In other implementations, a user may use washable sponges and wash the sponges between uses. In still other implementations, disposable sponges or single uses may be used and may be replaced after one application of make-up.

The method for applying make-up to a user's face may also include blending the make-up solution on the user's face. In various implementations, the make-up may be blended through one of stippling, rubbing, blending, or any combination thereof. In some implementations, the make-up may be blended using a brush, one or more fingers of a person applying make-up, one or more blending sponges, and other utensils for applying make-up. In various implementations, the make-up may be applied by a professional make-up artist. In some implementations, the make-up may be applied to one's own face.

In some implementations of beauty applicator systems, the system may be pre-loaded with make-up on the sponges and with the sponges coupled to the first side of the mask. In such implementations, a user may receive a beauty applicator system with a mask removably coupled with a tray and the sponges having make-up thereon. In some implementations, the beauty applicator mask may be used for applying face paint rather than a full face of skin tone make-up. For example, a sponge coupled to the first side of the mask may have a heart shape. The heart shaped sponge may be impregnated with, by non-limiting example, red or pink face paint. A shape of a heart may be applied to the face of a user by coupling the mask to the user's face and applying gentle pressure to the heart shaped sponge. In other implementations, beauty applicator systems may be used to apply face paint to a user that covers the entire face of a user. For example, the face paint may provide a cat face to the user when applied using implementations of a beauty applicator system. In some implementations, blending may be required in applying a full face of face paint. In other implementations, a full face of face paint may require no blending after transferring the face paint to the face of the user. In still other implementations, a beauty applicator system may be used to apply sports team themed make-up.

In places where the description above refers to particular implementations of beauty applicator systems and implementing components, sub-components, methods and sub-methods, it should be readily apparent that a number of modifications may be made without departing from the spirit thereof and that these implementations, implementing components, sub-components, methods and sub-methods may be applied to other beauty applicator systems.

What is claimed is:

1. A system for applying make-up to a user, the system comprising:

a mask comprising a first side and a second side, the mask comprising a shape of a human face, the first side of the mask configured to couple with a surface of a user's face;

one or more sponges coupled to the first side of the mask; and a tray corresponding with the shape of the mask, the tray comprising one or more cavities each corresponding with a position of each of the one or more sponges;

wherein the one or more cavities are configured to provide a seal around the one or more sponges when the first side of the mask is coupled with the tray.

2. The system of claim 1, wherein the mask is formed of one of silicone, plastic, plaster, thermoplastics, or any combination thereof.

3. The system of claim 1, wherein the one or more sponges are coupled to the first side of the mask through an adhesive.

4. The system of claim 1, wherein the one or more sponges are configured to correspond with at least a forehead of the user, one or more eyebrows of the user, a nose of the user, one or more cheekbones of the user, and a chin of the user.

5. The system of claim 1, further comprising tabs on one or more edges of the tray, the tabs configured to couple with the mask.

6. A system for applying make-up to a user, the system comprising:

a tray adapted to couple with a mask, the tray comprising two or more cavities positioned in correspondence with a position of each of two or more sponges of the mask;

wherein the two or more cavities are configured adapted to provide a seal around the two or more sponges when a first side of the mask is coupled with the tray.

7. The system of claim 6, further comprising tabs on one or more edges of the tray, the tabs adapted to couple with the mask.

8. A method for using a beauty applicator system, the method comprising:

providing a mask, the mask comprising a first side and a second side, the mask comprising a shape of a human face, the first side of the mask configured to couple with a surface of a user's face, wherein one or more sponges are coupled to the first side of the mask in one or more predetermined locations;

coupling the mask to a tray, the tray comprising one or more cavities each corresponding with a position of each of one or more sponges of the mask; and sealing the one or more cavities around the one or more sponges of the mask.

9. The method of claim 8, wherein the mask is formed of one of silicone, plastic, plaster, thermoplastics, or any combination thereof.

10. The method of claim 8, wherein the one or more sponges are coupled to the first side of the mask through an adhesive.

11. The method of claim 8, wherein the one or more sponges are configured to correspond with at least a forehead of the user, one or more eyebrows of the user, a nose of the user, one or more cheekbones of the user, and a chin of the human face.

12. The method of claim 8, wherein the sponges are configured to be washable and reusable with the mask.

13. The method of claim 8, wherein sealing the one or more cavities further comprises an airtight seal.

* * * * *